US009618218B2

(12) United States Patent
Naito et al.

(10) Patent No.: US 9,618,218 B2
(45) Date of Patent: Apr. 11, 2017

(54) AIR CONDITIONER

(75) Inventors: Koji Naito, Tokyo (JP); Yasutaka Yoshida, Tokyo (JP); Kazumoto Urata, Tokyo (JP); Hiroyuki Kawaguchi, Tokyo (JP); Yuki Furuta, Tokyo (JP); Kazuhiko Tani, Tokyo (JP)

(73) Assignee: Johnson Controls-Hitachi Air Conditioning Technology (Hong Kong) Limited, Kowloon Bay KLN (HK)

( * ) Notice: Subject to any disclaimer, the term of this patent is extended or adjusted under 35 U.S.C. 154(b) by 222 days.

(21) Appl. No.: 14/377,419

(22) PCT Filed: Feb. 9, 2012

(86) PCT No.: PCT/JP2012/000848

§ 371 (c)(1),
(2), (4) Date: Oct. 3, 2014

(87) PCT Pub. No.: WO2013/118174

PCT Pub. Date: Aug. 15, 2013

(65) Prior Publication Data

US 2015/0300662 A1 Oct. 22, 2015

(51) Int. Cl.
*F24F 1/32* (2011.01)
*F24F 1/28* (2011.01)

(52) U.S. Cl.
CPC . *F24F 1/32* (2013.01); *F24F 1/28* (2013.01)

(58) Field of Classification Search
CPC ..... F24F 1/32; F24F 1/28; F25B 41/00
See application file for complete search history.

(56) References Cited

U.S. PATENT DOCUMENTS

2003/0066302 A1* 4/2003 Ueno ..... F04B 39/0207 62/192
2007/0113582 A1* 5/2007 Sao ..... F25B 41/003 62/498

FOREIGN PATENT DOCUMENTS

CN 102192557 A 9/2011
CN 102278804 A 12/2011
(Continued)

OTHER PUBLICATIONS

Supplemental European Search Report issued in counterpart European Application No. 12867760.6 dated Jan. 11, 2016 (Six (6) pages).

(Continued)

*Primary Examiner* — Emmanuel Duke
(74) *Attorney, Agent, or Firm* — Crowell & Moring LLP

(57) ABSTRACT

Provided is an air conditioner which comprises multiple outdoor units, the air conditioner being configured so that, with the use of a low cost configuration, required refrigeration machine oil is supplied to all the outdoor units through refrigerant piping and so that the air conditioner has increased reliability. An air conditioner is provided with multiple indoor units and with four outdoor units which are connected to the multiple indoor units through refrigerant piping. A line of first refrigerant piping leading from the multiple indoor units is branched into two lines of second refrigerant piping, each of the two lines of second refrigerant piping is branched into two lines of third refrigerant piping, and the four lines of third refrigerant piping are respectively connected to the four outdoor units.

6 Claims, 5 Drawing Sheets

(56) References Cited

FOREIGN PATENT DOCUMENTS

| | | | | |
|---|---|---|---|---|
| EP | 1 750 072 | A1 | | 2/2007 |
| EP | 2 056 029 | A2 | | 5/2009 |
| EP | 2 365 254 | A2 | | 9/2011 |
| JP | 1-269843 | A | | 10/1989 |
| JP | 3-55471 | A | | 3/1991 |
| JP | 11083224 | A | * | 3/1999 |
| JP | 2001041528 | A | * | 2/2001 |
| JP | 2002-243314 | A | | 8/2002 |
| JP | 2005-345100 | A | | 12/2005 |
| JP | 2005345100 | A | * | 12/2005 |
| JP | 2007-139265 | A | | 6/2007 |
| JP | 2007139265 | A | * | 6/2007 |
| JP | 2008-128498 | A | | 6/2008 |
| JP | 2009210140 | A | * | 9/2009 |
| JP | 2010-164219 | A | | 7/2010 |
| JP | 2011-144941 | A | | 7/2011 |
| JP | 2012-17888 | A | | 1/2012 |

OTHER PUBLICATIONS

International Search Report (PCT/ISA/210) dated Apr. 24, 2012, with English translation (Four (4) pages).
Chinese Office Action issued in counterpart Chinese Application No. 201280069249.7 dated Mar. 28, 2016 with English-language translation (eight (8) pages).

* cited by examiner

OIL CIRCULATION AMOUNT
(OIL FLOW BIASED TO THE SMALLER UNIT NUMBER SIDE BY 7:3)

| OUTDOOR UNIT NO. | UNIT 1 | UNIT 2 | UNIT 3 | UNIT 4 | TOTAL |
|---|---|---|---|---|---|
| FIRST CONNECTING PIPE | 0.70 | 0.30 | | | 1.00 |
| SECOND CONNECTING PIPE | 0.70 | 0.21 | 0.09 | | 1.00 |
| OUTDOOR UNIT CONNECTING PIPE | 0.70 | 0.21 | 0.06 | 0.03 | 1.00 |

OIL CIRCULATION AMOUNT
(OIL FLOW BIASED TO THE SMALLER UNIT NUMBER SIDE BY 7:3)

| OUTDOOR UNIT NO. | UNIT 1 | UNIT 2 | UNIT 3 | UNIT 4 | TOTAL |
|---|---|---|---|---|---|
| FIRST CONNECTING PIPE | 0.70 | | 0.30 | | 1.00 |
| OUTDOOR UNIT CONNECTING PIPE | 0.49 | 0.21 | 0.21 | 0.09 | 1.00 |

AIR CONDITIONER

TECHNICAL FIELD

The present invention relates to an air conditioner, and particularly relates to a multi-type air conditioner provided with a plurality of outdoor units.

BACKGROUND ART

As a background art of the present invention, there are multi-type air conditioners connected with a plurality of indoor units as disclosed by Patent Document 1, and Patent Document 1 discloses a multi-type air conditioner in which two outdoor units are respectively connected with a plurality of indoor units through refrigerant pipes.

PRIOR ART DOCUMENT

Patent Document

Patent Document 1: Japanese Patent Application Publication No. 2008-128498

DISCLOSURE OF THE INVENTION

Problems to be Solved by the Invention

In recent years, needs of large capacity for a multi-type air conditioner are increasing due to reduction in installation cost or the like attained by intensive installation and piping. Consequently, in general, outdoor units to be base units for a large-capacity air conditioner are connected in a plural number at an installation site. Herein, in addition to refrigerant, refrigerant oil also flows inside refrigerant pipes connecting outdoor units and indoor units of an air conditioner, and oil flow may become uneven particularly at the branch portion of a gas refrigerant pipe during cooling operation.

In order to respond to a requirement for a large capacity of an air conditioner, for example, in case of connecting four or more outdoor units and using these outdoor units and indoor units by connecting these by refrigerant pipes, it is necessary to connect one gas pipe, which is connected with the indoor units, to the four outdoor units. However, depending on the connection method for this connection, supply of refrigerant oil to the outdoor units may become uneven. Particularly, for an outdoor unit to which supply of refrigerant oil has become extremely small, oil necessary for lubrication of a mounted compressor becomes insufficient, which may cause failure of lubrication of the compressor or a failure the compressor.

In Patent Document 1, although a case of connecting plural outdoor units is disclosed, nothing is disclosed about the above-described uneven supply of refrigerant oil. Incidentally, it is possible to consider additionally providing oil averaging pipes or the like to evenly supply refrigerant oil in order to prevent uneven supply of refrigerant oil to the outdoor units, however, it brings about disadvantages of increasing the man-hours of the installation at the site or increasing the manufacturing cost for configuration of oil averaging circuits for the outdoor units.

In this situation, an object of the present invention is to provide an air conditioner provided with a plurality of outdoor units wherein the air conditioner enables supplying necessary refrigerant oil to all the outdoor units through refrigerant pipes by an inexpensive configuration so that the reliability is improved.

Means for Solving the Problems

In order to solve the above-described problems, for example, arrangements set forth in the claims are adopted. Although the present application includes plural means for solving the above-described problems. As an example, an air conditioner includes: plural indoor units; and four outdoor units connected with the plural indoor units through refrigerant pipes, wherein one first refrigerant pipe from the plural indoor units branches into two second refrigerant pipes, wherein each of the two second refrigerant pipes branches into respective two third refrigerant pipes, and wherein these four third refrigerant pipes are connected to the four respective outdoor units.

Advantage of the Invention

According to the present invention, it is possible to ensure a necessary amount of oil circulation to an outdoor unit at the terminal of a multi-type air conditioner having plural outdoor units, during cooling operation.

Problems, arrangements, and advantages other than the above will be made clear by the description of the following embodiment.

EMBODIMENT FOR CARRYING OUT THE INVENTION

Figures 1, 2:
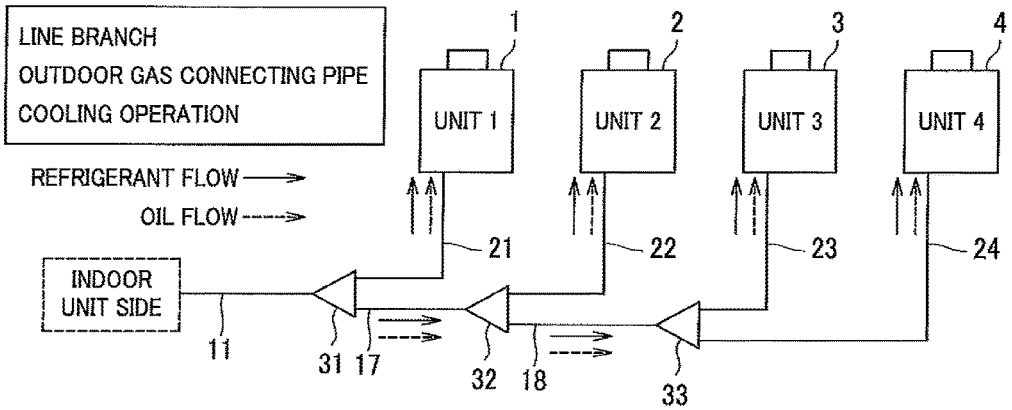
FIG. 1 is a diagram for illustration of an example of pipe installation where oil circulation amount is uneven for respective outdoor units.
FIG. 2 is a diagram showing an example of oil circulation amount uneven for the respective outdoor units.

An embodiment of an air conditioner according to the present invention will be descried below, referring to the drawings.

First, regarding a multi-type air conditioner provided with plural outdoor units, a method of connecting indoor units and four outdoor units will be described.

FIG. 1 shows an example of a pipe installation diagram of an air conditioner. This air conditioner is configured with four outdoor units, wherein one gas pipe and one liquid pipe are arranged toward indoor units. Incidentally, in the figure, only one pipe is shown because the object of the present embodiment is a gas pipe, and accordingly, a liquid pipe is omitted in the figure. The outdoor units will be referred to as first unit (unit 1), second unit (unit 2), third unit (unit 3), and fourth unit (unit 4) in the order closer to the indoor unit side. In order to connect a gas pipe 11 to the four outdoor units, the gas pipe 11 branches into two at a first branch pipe 31, wherein one end continues from an outdoor unit connecting pipe 21 to unit 1, and the other end continues to a first connecting pipe 17. The first connecting pipe 17 branches into two at a second branch pipe 32, wherein one end continues from an outdoor unit connecting pipe 22 to unit 2, and the other end continues to a second connecting pipe 18. The second connecting pipe 18 branches into two at a third branch pipe 33, wherein one end continues from an outdoor unit connecting pipe 23 to unit 3, and the other end continues from an outdoor unit connecting pipe 24 to unit 4. Herein, such a pipe installation will be referred to as line branch. In this line branch, the number of branch pipes on the route from the gas pipe 11 to an outdoor unit is different depending on the outdoor unit, and is one to three.

FIG. 2 is a diagram for description of oil circulation amounts to the respective units in the case of the line branch in FIG. 1. In a gas pipe, refrigerant gas and oil having flowed out from an outdoor unit circulate, wherein the flow is from the indoor units toward the outdoor units during cooling operation. Herein, a part of the oil in the pipes flows in a mist form, however, the rest flows in a liquid film form along the pipe walls. Accordingly, oil at a branch pipe portion is affected not only by the flow of the refrigerant but also by the shape, the slant, and the like of the branch pipe, which causes unevenness of oil distribution. The outdoor gas connection pipes during cooling operation will be described taking an example that the dividing ratio of the oil in flowing from a branch pipe portion into two pipes is 7:3, wherein unevenness or bias occurs such that 7 is on the side with a smaller outdoor unit number, and 3 is on the side with a larger outdoor unit number. Actual oil dividing ratio and direction of unevenness are uncertain, and numerical values are accordingly merely in an example. If the oil circulation amount in the gas pipe 11 is represented by 1, first, at the branch pipe 31, oil is divided into 0.70 for the outdoor unit connecting pipe 21 (unit 1 side) and into 0.30 for the first connecting pipe 17. Further, the oil circulation amount 0.30 at the first connecting pipe 17 is divided into 0.21 for the outdoor unit connecting pipe 22 (unit 2 side) and into 0.09 for the second connecting pipe 18. Still further, the oil circulation amount 0.09 at the second connecting pipe 18 is divided into 0.06 for the outdoor unit connecting pipe 23 (unit 3 side), and into 0.03 for the outdoor unit connecting pipe 24 (unit 4 side).

In such a manner, according to the method, shown in FIG. 1, of connecting pipes, the oil circulation amount is extremely small to be 0.03 for the unit 4 at the terminal. If the oil circulation amount is extremely small, it is possible that oil necessary for lubrication of the compressor mounted on the outdoor unit (unit 4) becomes insufficient, which may cause bad lubrication or failure of the compressor. In order to prevent this, it is possible to consider additionally providing oil averaging pipes between outdoor units to thereby average oil, however, such arrangement is disadvantageous in increasing the man-hours for installation at site, increasing the manufacturing cost for structuring outdoor unit oil averaging circuits, or the like.

In this situation, for a multi-type air conditioner with four outdoor units in the present embodiment, it will be described about a method of inexpensively ensuring an oil circulation amount, the oil circulation amount being necessary for the compressor, to the terminal outdoor unit during cooling operation, by changing the pipe connecting method for connecting gas pipes and outdoor units will be described.

Figures 3, 4:
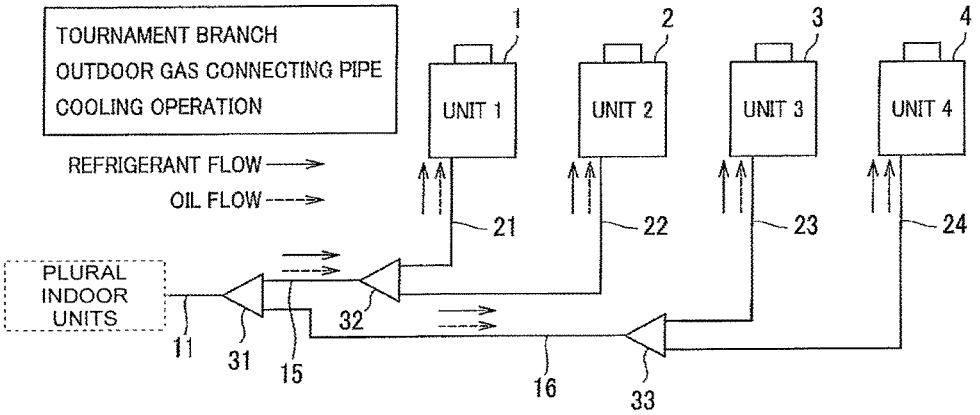
FIG. 3 shows a pipe installation diagram in an embodiment.
FIG. 4 shows an example of oil circulation amounts for respective outdoor units according to the pipe installation diagram in FIG. 3.

FIG. 3 is a diagram for illustration of a pipe installation diagram in the present embodiment. This air conditioner is configured with four outdoor units similarly to FIG. 1, and one gas pipe and one liquid pipe are arranged toward indoor units. Further, in the figure, only gas pipes are shown and liquid pipes are omitted, similarly to FIG. 1. In order to connect a gas pipe 11 to the four outdoor units, the gas pipe 11 branches into two at a branch pipe 31 to continue to a first connecting pipe 15 and a first connecting pipe 16. The first connecting pipe 15 branches into two at a second branch pipe 32, wherein one end continues from an outdoor unit connecting pipe 21 to unit 1, and the other end continues from an outdoor unit connecting pipe 22 to unit 2. Likewise, a first connecting pipe 16 also branches into two at a third branch pipe 33, wherein one end continues from an outdoor unit connecting pipe 23 to unit 3, and the other end continues from an outdoor unit connecting pipe 24 to unit 4. Such pipe installation will be herein referred to as tournament branch.

FIG. 4 is a diagram for description of oil circulation amounts to the respective units in FIG. 1. In a gas pipe, refrigerant gas and oil having flowed out from an outdoor unit circulate, wherein the flow is from the indoor units toward the outdoor units during cooling operation. Herein, a part of the oil in the pipes flows in a mist form, however, the rest flows in a liquid film form along the pipe walls. Accordingly, oil at a branch pipe portion is affected not only by the flow of the refrigerant but also by the shape, the slant, and the like of the branch pipe, which causes unevenness of oil distribution. Herein, the dividing ratio of the oil is assumed to be 7:3 similarly to FIG. 2, wherein at the branch pipe portion, oil distribution is assumed to be uneven by 7 on the side with a smaller outdoor unit number, and 3 on the side with a larger outdoor unit number. Actual oil dividing ratio and direction of unevenness are uncertain, and numerical values are merely an example.

Incidentally, regarding liquid pipes, although flow is toward the outdoor units during heating, the flow does not become a flow of refrigerant gas and a flow of oil film like in gas pipes, and oil mixes with liquid refrigerant or melts in. Consequently, distribution with substantially the same ratio as the refrigerant circulation amount is possible, and tournament branch shown in the diagram is not always necessary. On the other hand, as branch pipes for gas pipes and liquid pipes are installed at substantially the same positions in installation, installation similar to the installation of gas pipes may be carried out. Further, for air conditioners whose indoor units perform simultaneous cooling and heating operations, tournament branch is necessary similarly to FIG. 3, in case of installing high-low pressure gas pipes separately from gas pipes and making the pressure of the high-low pressure gas pipes low during when the indoor units perform cooling operation for all rooms so that refrigerant gas and refrigerant oil flow from the indoor units toward the outdoor units.

As shown in FIG. 4, if the oil circulation amount in the gas pipe 11 is represented by 1, oil is divided into 0.70 for the first connecting pipe 15 and into 0.30 for the first connecting pipe 16. The oil circulation amount 0.70 at the first connecting pipe 15 is divided into 0.49 for the outdoor unit connecting pipe 21 (unit 1 side) and into 0.21 for the outdoor unit connecting pipe 22 (unit 2 side). The oil circulation amount 0.30 at the first connecting pipe 16 is divided into 0.21 for the outdoor unit connecting pipe 23 (unit 3 side) and into 0.09 for the outdoor unit connecting pipe 24 (unit 4 side).

In such a manner, by the tournament branch in FIG. 3, the number of branch pipes on the route from a gas pipe to an outdoor unit is only two for all the outdoor units. Herein, by comparison of the oil circulation amount to unit 4 with that in the case of FIG. 1 (FIG. 2), it is recognized that while the oil circulation amount is 0.03 for unit 4 in FIG. 2, the oil circulation amount is larger to be 0.09 for unit 4 in FIG. 4. Incidentally, the value of the oil circulation amount 0.09 to unit 4 in FIG. 4 is the same as the oil circulation amount 0.09 of the flow in the second connecting pipe 18 in FIG. 2.

Herein, it can be said that, for the outdoor unit connecting pipe 24 (unit 4 side) in FIG. 3 and the second connecting pipe 18 in FIG. 1, the oil circulation amounts of these pipes are equal as the number of branch pipes on the route from a gas pipe to the outdoor unit is two. It can be said on the other hand, for the outdoor unit connecting pipe 24 (unit 4 side) in FIG. 1, the oil circulation amount is low as the number of branch pipes on the rout from the gas pipe to the outdoor unit is three. Incidentally, regarding liquid pipes, although there is a flow toward the outdoor units during heating, the flow does not become refrigerant gas and oil film like those in the gas pipes, and oil mixes in or melts in the liquid refrigerant so that dividing is possible with a ratio substantially the same as the ratio on the refrigerant circulation amount. Thus, the tournament branch, as shown, is not always necessary. On the other hand, as branch pipes for gas pipes and liquid pipes are installed at substantially the same positions in installation, installation similar to the installation of gas pipes may be carried out. Further, for an air conditioner whose indoor units perform simultaneous cooling and heating operations, tournament branch is necessary, similarly to FIG. 3, in case of installing high-low pressure gas pipes separately from gas pipes and making the pressure of the high-low pressure gas pipes low during when the indoor units perform cooling operation for all rooms so that refrigerant gas and refrigerant oil flow from the indoor units toward the outdoor units.

As described above, the air conditioner in FIG. 3 includes plural indoor units, not shown, and four outdoor units (unit 1, unit 2, unit 3, unit 4) connected to these plural indoor units through refrigerant pipes. Herein, one first refrigerant pipe (gas pipe 11) from the plural indoor units is branched into two second refrigerant pipes (the first connecting pipes 15, 16); these two second refrigerant pipes (the first connecting pipes 15, 16) are branched respectively into two third refrigerant pipes (the outdoor unit connecting pipes 21, 22, 23, 24); and these four third refrigerant pipes (the outdoor unit connecting pipes 21, 22, 23, 24) are respectively connected to the four outdoor units (unit 1, unit 2, unit 3, unit 4).

By this arrangement, even in a case that dividing of oil at a branch pipe portion is uneven and supply of refrigerant oil becomes extremely small when line branch is adopted, the tournament branch in the present embodiment enables supply of a necessary oil circulation amount to the terminal outdoor unit even when four outdoor units are connected. Thus, failure of the compressor is prevented and the reliability of the air conditioner is improved.

Incidentally, connecting pipes for outdoor units are installed such that the respective pipes are disposed side by side at the same height in the front or back space of the outdoor units, and it is thus required to provide high-low gaps between respective pipes if the connecting pipes intersect with each other, which is undesirable, requiring additional work in installation. As shown in FIG. 3, the two second refrigerant pipes (the first connecting pipes 15, 16) and the four third refrigerant pipes (outdoor unit connecting pipes 21, 22, 23, 24) are arranged such as to be connected without intersection with each other to the outdoor units, and it is thereby possible to eliminate the necessity of providing high-low gaps between pipes and reduce work in installation.

Figure 5:
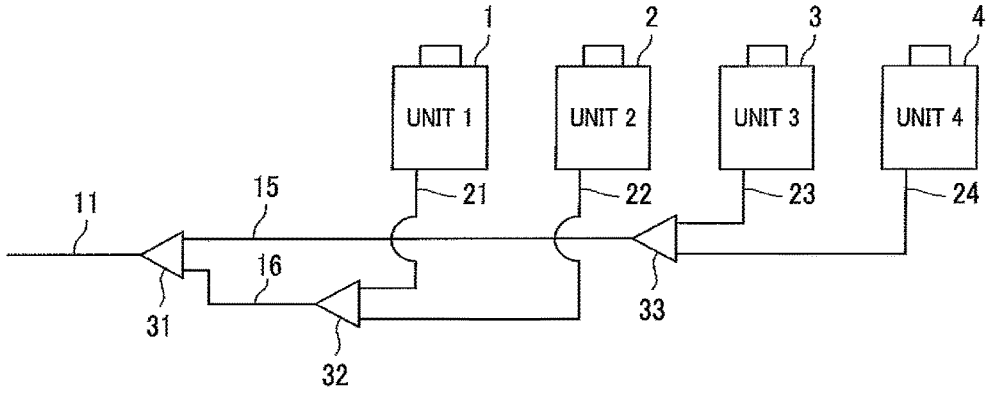
FIG. 5 shows an example of a pipe installation diagram in which connecting pipes intersect with each other.
Figure 6:
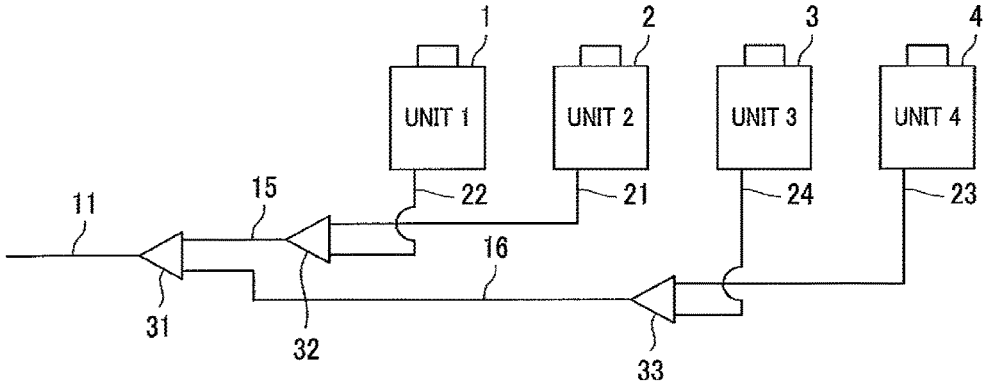
FIG. 6 shows an example of a pipe installation diagram in which connecting pipes intersect with each other.
Figure 7:
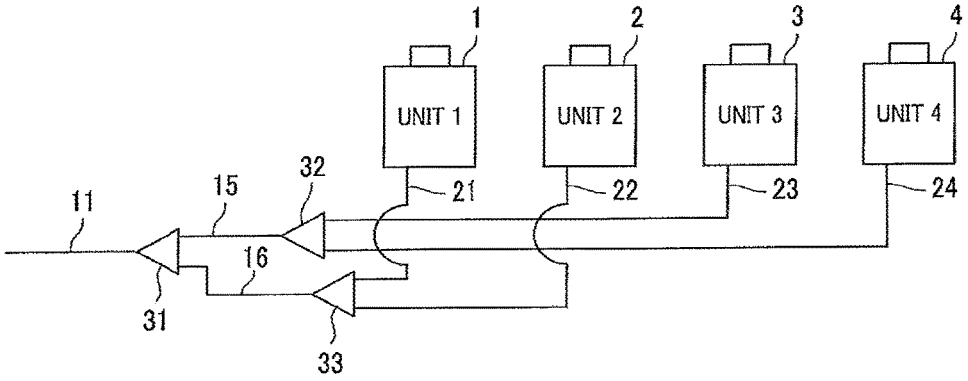
FIG. 7 shows an example of a pipe installation diagram in which branch pipes are disposed on the front side of the outdoor units (on the indoor unit side)

For example, FIGS. 5-7 show examples of installation in which connecting pipes intersect with each other. Incidentally, the lines of the connecting pipes installed in parallel with installation of the outdoor units in the figures are shown, with consideration of the longer/shorter distance between the outdoor units and the pipes.

FIG. 5 shows an example of installation in which connecting pipes intersect, wherein an outdoor unit connecting pipe 21 and an outdoor unit connecting pipe 22 intersect with a first connecting pipe 15. In order to realize this installation, it is necessary to make the intersection such as to dispose the first connecting pipe 15 lower or dispose the outdoor unit connecting pipe 21 and outdoor unit connecting pipe 22 higher, which increases the work of pipe installation. This problem can be reduced by connecting, as shown in FIG. 3, the first connecting pipe 15 and a second branch pipe 32 and connecting a first connecting pipe 16 and a third branch pipe 33, instead of connecting the first connecting pipe 15 and the third branch pipe 33 and connecting the first connecting pipe 16 and the second branch pipe 32.

FIG. 6 shows an example of installation in which connecting pipes intersect, wherein an outdoor unit connecting pipe 22 intersects with an outdoor unit connecting pipe 21, and an outdoor unit connecting pipe 24 intersects with an outdoor unit connecting pipe 23. This problem can be reduced by connecting, as shown in FIG. 3, the outdoor unit connecting pipe 21 with unit 1, the outdoor unit connecting pipe 22 with unit 2, the outdoor unit connecting pipe 23 with unit 3, and the outdoor unit connecting pipe 24 with unit 4, instead of connecting the outdoor unit connecting pipe 22 with unit 1, the outdoor unit connecting pipe 21 with unit 2, the outdoor unit connecting pipe 24 with unit 3, and the outdoor unit connecting pipe 23 with unit 4.

FIG. 7 shows an example of installation in which connecting pipes intersect, wherein outdoor unit connecting pipes 21, 22 intersect with outdoor unit connecting pipes 23, 24. Herein, four outdoor units are arrayed in the order of a first outdoor unit (unit 1), a second outdoor unit (unit 2), a third outdoor unit (unit 3), and a fourth outdoor unit (unit 4), and outdoor unit connecting pipes are connected to the respective outdoor units, as shown in FIG. 7. Further, a third branch pipe 33 and a second branch pipe 32 are disposed on the front side of the first outdoor unit (unit 1) with respect to the direction along which the outdoor units (unit 1, unit 2, unit 3, unit 4) are arrayed.

The third branch pipe 33 and the second branch pipe 32 are actually large, and there is a case that it is desired to ensure the front space of the outdoor units (or a back space) in installation. In this situation, the front space can be ensured by disposing the third branch pipe 33 and the second branch pipe 32 as shown in FIG. 7. Incidentally, in FIG. 7, although the outdoor unit connecting pipes intersect with each other as described above, it is possible to further omit a work in installation by connecting, as shown in FIG. 3, the second branch pipe 32 with unit 1 and unit 2, and the third branch pipe 33 with unit 3 and unit 4, instead of connecting the second branch pipe 32 with unit 3 and unit 4, and the third branch pipe 33 with unit 1 and unit 2.

Incidentally, in every figure, a refrigerant pipe before a branch is thicker than a refrigerant pipe after the branch. For example, in FIG. 7, the second refrigerant pipes (first connecting pipes 15, 16) are thicker pipes than the third refrigerant pipes (the outdoor unit connecting pipes 21, 22, 23, 24). Further, the gas pipe 11 is a pipe thicker than the second refrigerant pipes (the first connecting pipes 15, 16). In FIG. 7, the second refrigerant pipes (the first connecting pipes 15, 16) are shorter than the third refrigerant pipes (the outdoor unit connecting pipes 21, 22, 23, 24), and as the cost of a thicker pipe is higher, the cost of pipes can be reduced compared with the arrangement in FIG. 3.

Figure 8:
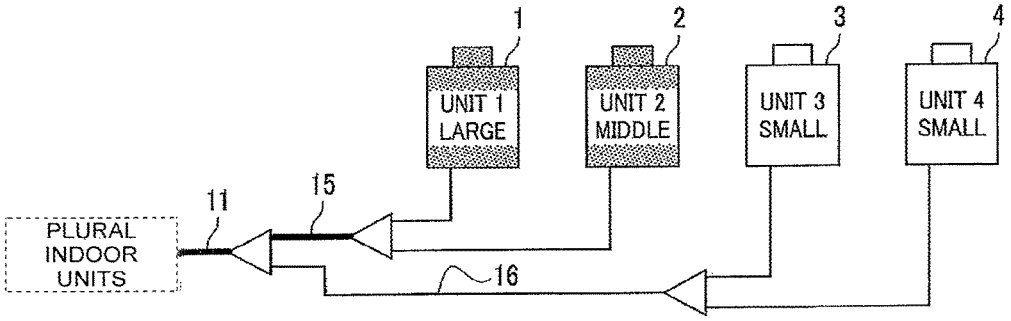
FIG. 8 shows an installation diagram in which outdoor units are disposed in the order of larger capacity.

FIG. 8 regards the disposition of outdoor units, and is a diagram of installation in which outdoor units are installed such that the capacity of an outdoor unit is larger in the order of a shorter distance from the indoor unit side. It will be assumed that base outdoor unit are categorized in three kinds, namely larger, middle, and smaller in terms of capacity, and a unit with a larger capacity will be referred to as unit 1, a unit with a middle capacity will be referred to as unit 2, and units with a smaller capacity will be referred to as unit 3 and unit 4. Herein, the pipe diameter of a connecting pipe changes depending on the capacity of an outdoor unit connected to the pipe. For example, as the gas pipe 11 is connected with all the four outdoor units, it is necessary to make the pipe diameter thick to prevent a pressure loss in the pipe. Further, in comparison between the pipe diameters of the first connecting pipe 15 and the first connecting pipe 16, the first connecting pipe 15 is for a combination of outdoor units with a larger and middle capacities while the first connecting pipe 16 is for a combination of two outdoor units with a smaller capacity, and accordingly, the pipe diameter of the first connecting pipe 15 is larger.

Herein, if pipes do not intersect with each other, the length of the first connecting pipe 15 is shorter than that of the first connecting pipe 16. That is, as it is possible to perform installation, making the diameter of a pipe with a larger pipe diameter shorter, advantages in the installability and the cost of pipe material can be obtained. Incidentally, for the gas pipe 11, the first connecting pipe 15, and the first connecting pipe 16 in FIGS. 8-10, the largeness and smallness of the diameters of pipes are represented by different simulative thicknesses of the lines representing the pipes. In comparison of the diameters of the pipes in FIG. 8, gas pipe 11>first connecting pipe 15>first connecting pipe 16.

Figure 9:
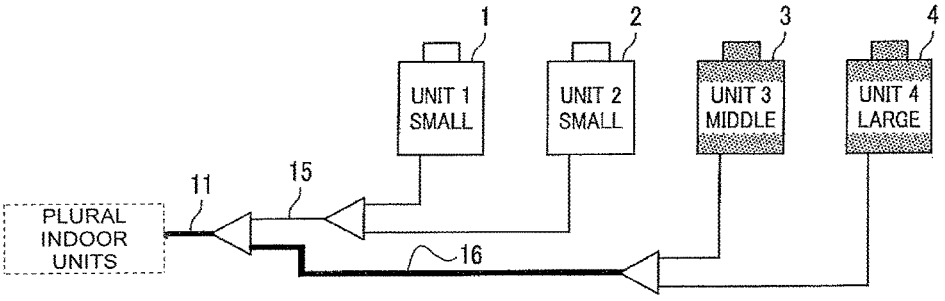
FIG. 9 shows an installation diagram in which outdoor units are disposed in the order of smaller capacity.

FIG. 9 regards the disposition of outdoor units, and is a diagram of installation in which outdoor units are installed such that the capacity of an outdoor unit is smaller in the order of a shorter distance from the indoor unit side. Units with a smaller capacity will be referred to as unit 1 and unit 2, a unit with a middle capacity will be referred to as unit 3, and units with a larger capacity will be referred to as unit 4. Herein, in comparison of the pipe diameters of the first connecting pipe 15 and the first connecting pipe 16, the first connecting pipe 16 is for a combination of outdoor units with larger and middle capacities while the first connecting pipe 15 is for two outdoor units with a smaller capacity, and accordingly, the pipe diameter of the first connecting pipe 16 is larger. Herein, the length of the first connecting pipe 16 is larger than that of the first connecting pipe 15, which means installation making the length of a pipe with a larger diameter large, compared with the installation in FIG. 8, causing disadvantages in installability and the cost of pipe material.

Figure 10:
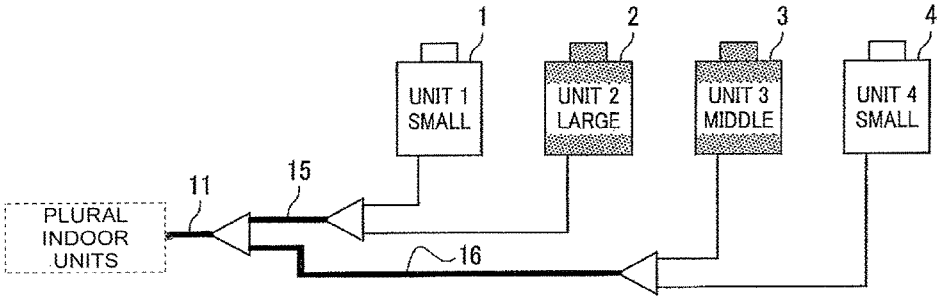
FIG. 10 shows an installation diagram in which outdoor units are disposed with a large capacity and a small capacity alternately.

FIG. 10 regards the disposition of outdoor units and is a diagram of installation in which outdoor units are installed such that the capacity of an outdoor unit is larger and smaller alternately in the order of a shorter distance from the indoor unit side. Outdoor units with a smaller capacity will be referred to as unit 1 and unit 4, an outdoor unit with a middle capacity will be referred to as unit 3, and an outdoor unit with a larger capacity will be referred to as unit 2. Further, in comparison of the pipe diameters of the first connecting pipe 15 and the first connecting pipe 16, the first connecting pipe 16 is for a combination of outdoor units with larger and smaller capacities while the first connecting pipe 15 is for a combination of a middle and smaller capacities, and accordingly, it can be said that the pipe diameter of the first connecting pipe 15 and that of the first connecting pipe 16 make little difference. However, in comparison between the first connecting pipe 16 in FIG. 8 and the first connecting pipe 16 in FIG. 10, the first connecting pipe 16 in FIG. 10 is thicker. In comparison between the first connecting pipe 15 in FIG. 8 and the first connecting pipe 15 in FIG. 10, the first connecting pipe 15 in FIG. 8 is thicker in reverse, however, the length of the first connecting pipe 16 is larger than that of the first connecting pipe 15, which means installation comprehensively making the length of a pipe with a larger diameter larger, compared with the installation in FIG. 8, resulting in disadvantages in installability and the cost of the connecting pipe material.

DESCRIPTION OF REFERENCE SYMBOLS

1: (outdoor unit) first unit
2: (outdoor unit) second unit
3: (outdoor unit) third unit
4: (outdoor unit) fourth unit
11: gas pipe
15, 16, 17: first connecting pipe
18: second connecting pipe
21, 22, 23, 24: outdoor unit connecting pipe
31: branch pipe
32: second branch pipe
33: third branch pipe

The invention claimed is:

1. An air conditioner, comprising:
plural indoor units; and
four outdoor units connected with the plural indoor units through refrigerant pipes,
wherein one first refrigerant pipe from the plural indoor units branches into two second refrigerant pipes,
wherein each of the two second refrigerant pipes branches into respective two third refrigerant pipes,
and wherein these four third refrigerant pipes are connected to the four respective outdoor units.

2. The air conditioner according to claim 1,
wherein the two second refrigerant pipes and the four third refrigerant pipes do not intersect with each other.

3. The air conditioner according to claim 1,
wherein the four outdoor units are arrayed in an order of a first outdoor unit, a second outdoor unit, a third outdoor unit, and a fourth outdoor unit,
wherein the two second refrigerant pipes are branched from the first refrigerant pipe through a first branch pipe,
wherein two of the third refrigerant pipes are branched from one of the second refrigerant pipes through a second branch pipe and are connected respectively with the first outdoor unit and the second outdoor unit, wherein the other two of the third refrigerant pipes are branched from the other one of the second refrigerant pipes through a third branch pipe and are connected respectively with the third outdoor unit and the fourth outdoor unit, and wherein the second branch pipe and the third branch pipe are disposed such as to be located on a front side of the first outdoor unit with respect to a direction along which the outdoor units are arrayed.

4. The air conditioner according to claim 1, wherein the second refrigerant pipes are pipes thicker than the third refrigerant pipes and shorter than the third refrigerant pipes.

5. The air conditioner according to claim 1, wherein the first outdoor unit has a largest capacity of the four outdoor units and the four outdoor units are arrayed in an order of the first outdoor unit, the second outdoor unit, the third outdoor unit, and the fourth outdoor unit, wherein the two second refrigerant pipes are branched from the first refrigerant pipe, wherein two of the third refrigerant pipes, the two being branched from one of the second refrigerant pipes, are connected respectively with the first outdoor unit and the second outdoor unit, wherein two of the third refrigerant pipes, the two being branched from the other one of the second refrigerant pipes, are connected respectively with the third outdoor unit and the fourth outdoor unit, and wherein the one of the second refrigerant pipes is a pipe thicker than the other one of the second refrigerant pipes.

6. The air conditioner according to claim 5, wherein the second outdoor unit has a second largest capacity of the four outdoor units or has the same capacity as the first outdoor unit.

* * * * *